US006681701B2

(12) United States Patent
Perry

(10) Patent No.: US 6,681,701 B2
(45) Date of Patent: Jan. 27, 2004

(54) BLASTING CONNECTOR BLOCK

(76) Inventor: Garnet Perry, 152, Terrasse Marc-Antoine, Ste-Anne-de-Bellevue, Quebec (CA), H9X 3W6

( * ) Notice: Subject to any disclaimer, the term of this patent is extended or adjusted under 35 U.S.C. 154(b) by 92 days.

(21) Appl. No.: 10/057,683

(22) Filed: Jan. 23, 2002

(65) Prior Publication Data

US 2002/0100388 A1 Aug. 1, 2002

(30) Foreign Application Priority Data

Feb. 1, 2001 (CA) ..... 2333842

(51) Int. Cl.[7] ..... F24B 39/30
(52) U.S. Cl. ..... 102/275.7
(58) Field of Search ..... 102/275.7

(56) References Cited

U.S. PATENT DOCUMENTS 4,714,017 A * 12/1987 Kelly et al. ..... 102/275.3
4,730,560 A * 3/1988 Bartholomew et al. .. 102/275.3
5,204,492 A * 4/1993 Jacob et al. ..... 102/275.12
5,299,500 A * 4/1994 Lindquist et al. ..... 102/275.2
5,499,581 A * 3/1996 Sutula, Jr. ..... 102/275.12
5,703,319 A * 12/1997 Fritz et al. ..... 102/275.7

* cited by examiner

*Primary Examiner*—Charles T. Jordan
*Assistant Examiner*—Bret Hayes

(57) ABSTRACT

A block connector for holding both a detonator, having an explosive end, and signal lines. The connector has a body member and a cover. The body member has an elongated, open, base and a connector head at one end of the base. The connector head holds the signal lines. The base has a support for supporting the detonator in an operative position with its explosive end in at least close proximity to the signal lines held in the connector head. The cover is locked to the base over the detonator when the detonator is mounted on the support in the operative position and a retainer on the cover retains the detonator in the operative position. The cover preferably is separate from the body member.

17 Claims, 2 Drawing Sheets

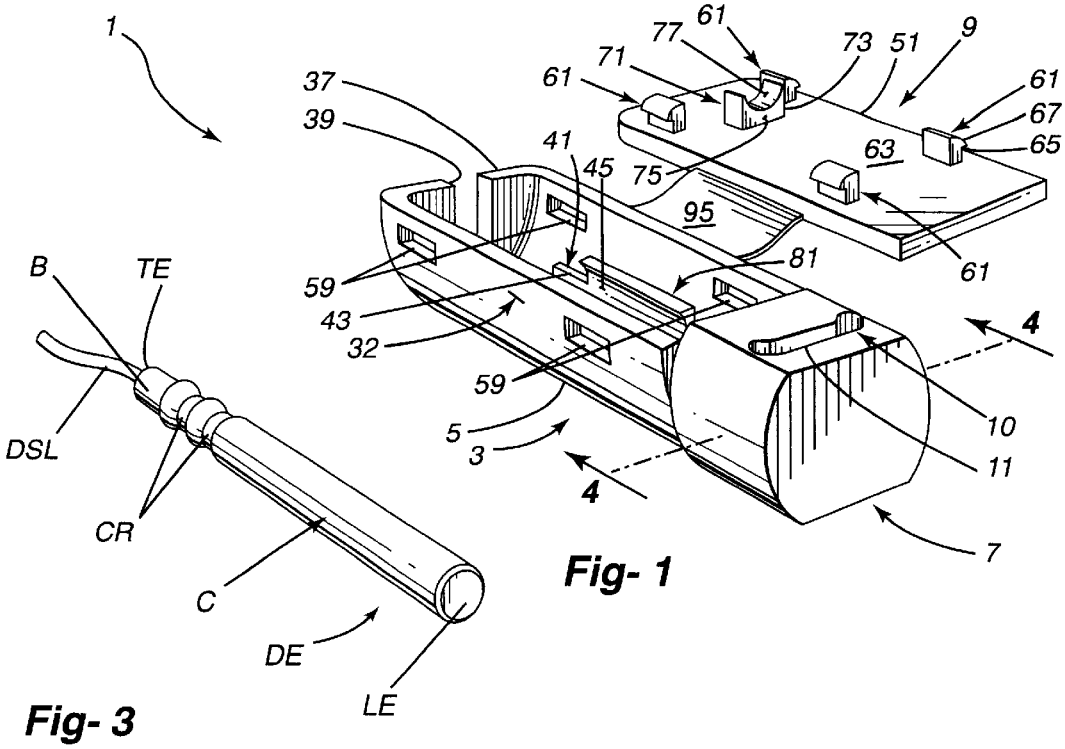
Fig- 1
Fig- 3
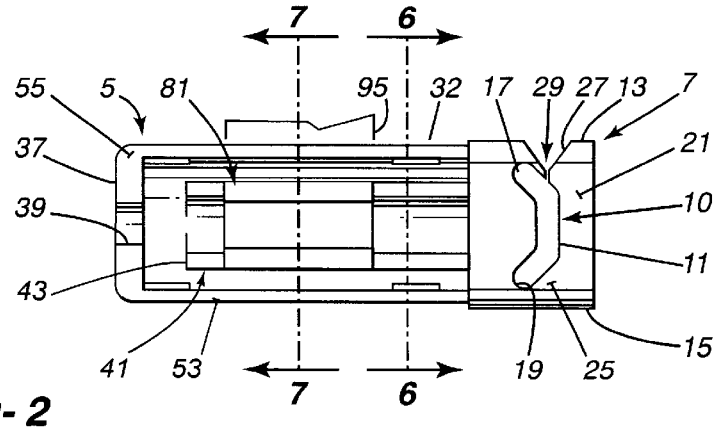
Fig- 2
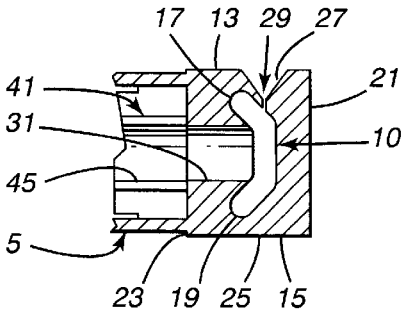
Fig- 4
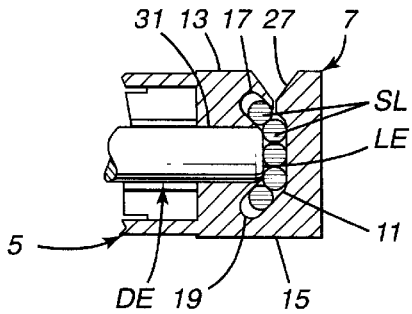
Fig- 5

BLASTING CONNECTOR BLOCK

BACKGROUND OF THE INVENTION

1. Field of the Invention

This invention is directed toward a connector block used in blasting.

2. Description of the Related Art Including Information Disclosed Under CFR §§1.97–1.99

Connector blocks are used in blasting to connect a small detonator to a signal transmission line to form a blasting device. One form of connector block has an elongated body for holding both a detonator and at least one signal line, the detonator held in a position where the explosive end of the detonator is in close proximity to, and preferably contacts, the signal line extending across the explosive end of the detonator. The connector usually has means for trying to prevent movement of the detonator, relative to the connector and to the signal line, once it is mounted in the connector, in order to have the detonator maintain contact with the signal line.

One known form of this connector is in one piece and employs an elongated body member having a U-shaped cross-section. The detonator is placed in the interior of the body member through an open end in the body member with its explosive end in close proximity to, and preferably contacting, at least one signal line held transversely to the detonator at the opposite closed end of the body member. The interior surface of the wall defining the elongated U-shaped body member has retaining ribs for retaining the detonator from both transverse and longitudinal movement. Another known form of connector is initially in one piece and has a closed tubular body member which holds the detonator against lateral movement. This connector has an integral locking member, the locking member severable from the body member and moveable transversely to the body member to securely hold the detonator in place against longitudinal movement. The locking member is initially integral with the body, but separates from the body member when moved to a locking position. An example of such a connector is shown in U.S. Pat. No. 5,499,581, issued Mar. 19, 1996, Daniel P. Sutula, Jr., inventor.

There are disadvantages in using the known connectors however. The connector with a body member of unshaped cross-section, not withstanding the retaining means on the body member, allows the detonator to be too easily moved transversely. This could move the explosive end of the detonator too far from the signal lines making the assembled blasting device inoperative. The connectors are usually printed with information relating to their use. However, the known one-piece connectors are normally made from a plastic material that requires flame treatment to allow the material to be printed on. Flame treatment is an expensive additional manufacturing step and, in an explosive environment, where the connectors are assembled with the detonators and signal lines, could be dangerous. The one-piece connectors can also be more difficult to mold and, when employing a tubular body member, make it more difficult to inspect the molded body member to ensure that the area where the connection is made between the detonator and the signal line is free from flashing from the molding operation. Any flashing could interfere with the proper operation of the blasting device.

SUMMARY OF THE INVENTION

It is the purpose of the present invention to provide a connector that is simple to manufacture and that securely holds a detonator mounted in the connector in contact with a signal line. The connector of the present invention prevents movement of the detonator in both the longitudinal and transverse directions relative to the connector body member once it is mounted in place. It is another purpose to provide a connector in which a detonator can be easily loaded into the connector. It is a further purpose of the present invention to provide a connector which can be more easily checked that it is properly molded without flashing. In one embodiment of the invention it is a purpose to provide a connector which can be easily printed on without requiring flame treatment. In this embodiment, the connector has a separate cover which can be made from easily printed material.

The invention provides a connector block having a body member with an elongated, open, base and a connector head at one end. The connector head has a slot extending transversely to the long direction of the base with the slot being just wide enough to clampingly receive one or more signal lines. An opening extends through the head from the base side to the slot for snugly receiving one end of a detonator. Support means on the base are aligned with the opening in the end wall, the support means supporting the detonator while its front end is in the opening contacting the signal lines in the slot. A cover closes the open base with the detonator on the base. The cover and base have cooperating locking means for locking the cover to the base in the closed position. The cover includes separate retainer means cooperating with the detonator to prevent the detonator from both moving rearwardly longitudinally away from the slot and from moving transversely. The cover can be can be an integral part of the body member, connected to the base along one side by a flexible strip. Alternatively, the cover can be a separate member from the body member.

Since the base is open, a person can check that the base has been molded correctly and that there is no flashing in the detonator receiving opening in the connecting head. The open base also allows the base to be easily molded and the detonator to be easily mounted on the base. The cover locks easily and securely to the base and securely holds the detonator against any movement through the retaining means on the cover. If the cover is separate from the body member, it can be made from a material different from the material of the body member which cover material allows printing without the material having to be flame treated. The separate covers allows both the body member and cover to be more easily molded. Using a separate cover allows the covers to be preprinted and stockpiled for use with the body members.

The invention is particularly directed toward a block connector for holding a detonator having an explosive end. The connector has a body member and a cover. The body member has an elongated, open, base and a connector head at one end of the base, the connector head having holding means for holding one or more signal lines. The base has support means for supporting the detonator in an operative position on the body member with its explosive end in at least close proximity with the signal lines held in the connector head. Locking means on the connector lock the cover to the base over the detonator when the detonator is mounted on the support means in the operative position. Retainer means on the cover retain the detonator in the operative position when the cover is locked to the base, the retainer means preventing at least longitudinal movement of the detonator.

BRIEF DESCRIPTION OF THE DRAWINGS

FIG. 1 is perspective view of the connector with the cover in an open position;

FIG. 2 is a top view of the connector;

FIG. 3 is a perspective view of the detonator;

FIG. 4 is a partial cross-section view of the connector taken along line 4—4 in FIG. 1;

FIG. 5 is a view the same as FIG. 4 but with the detonator and signal lines in place;

DESCRIPTION OF THE PREFERRED EMBODIMENTS

Figure 6:
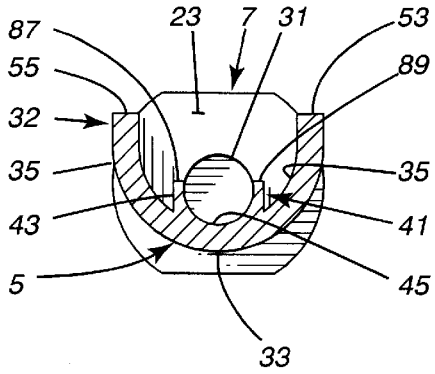
FIG. 6 is a cross-section view along line 6—6 in FIG. 2.

The connector block 1, as shown in FIGS. 1 and 2, has an elongated body member 3 with an open base 5 and a connector head 7 at one end of the base. The connector block 1 includes a cover 9 to close the base 5 to retain a detonator DE within the connector block.

The detonator DE, as shown in FIG. 3, has a tubular casing C with a closed, leading end LE filled with explosive material and an open, trailing end TE. The casing C is preferably cylindrical in shape although it could have other shapes. The open, trailing end TE of the casing C is closed by a resilient bushing B through which a detonator signal line DSL is passed into the casing C. The casing C is crimped about the bushing B at least once as shown at CR and preferably twice. Detonators of this type are well known in the blasting industry.

In more detail, as shown in FIG. 4, the connector head 7 on the body member 3 of the connector block 1 has holding means 10 for holding one or more signal lines SL, preferably to extend in a direction transverse to the base 5. The signal lines SL can be shock tubes, LVST tubes, low energy detonating cords or the like. The signal lines transmit a signal when activated by the detonator exploding and are well known in the blasting industry. The holding means 10 includes a slot 11 formed centrally in the connector head 7, the slot 11 extending generally from near the one side 13 of the head 7 to near the other side 15. The ends 17, 19 of the slot 11 are curved inwardly toward the base 5. The slot 11 divides the head 7 into an outer head portion 21 and an inner head portion 23 adjacent the base 5. The outer head portion 21 is joined to the inner head portion 23 by a bridge 25 at the side 15 of the head 7. Entrance to the slot 11 is through a v-shaped groove 27 in the side 13 of the head 7, the bottom of the groove 27 joined to the slot 11 by a narrow channel 29.

The slot 11 is slightly narrower than the diameter of the signal lines SL to clamp them in the slot between the outer and inner head portions 21, 23. The lines SL are inserted into the slot 11 through the groove 27 and the channel 29, the outer head portion 21 of the head 7 flexing away from the inner head portion 23 about the bridge 25, to allow entry of the lines SL through the groove 27 and the channel 29 into the slot 11. The lines SL, when mounted in the slot 11, extend transverse to the long direction of the base 5 and are clamped between the head portions 21, 23 as shown in FIG. 5.

A central opening 31 is provided in the inner head portion 23 of the head 7 extending from the open base 5 to the slot 11. The mouth of the opening 31 will preferably open up into the curvrd end portions of the slot as well as the straight central portion as shown in FIG. 4. The opening 31 receives the leading explosive end LE of the detonator DE as shown in FIG. 5. Preferably, the opening 31 snugly receives the detonator DE. The leading end LE of the detonator DE will abut at least one signal line SL in the slot 11 opposite the opening 31 to limit its forward longitudinal movement and preferably will abut all the signal lines held in the slot. The leading end LE of the detonator DE need not always abut the signal lines to have the device operate properly. Sometimes it is only necessary that the leading end LE be maintained in close proximity to the signal lines SL to have proper operation.

The base 5 has a side wall 32 defined by a bottom wall portion 33 with side wall portions 35 extending upwardly therefrom as shown in FIGS. 1, 2 and 6. Preferably the lower portion of the side wall portions 35 are curved and merge smoothly into the bottom wall portion 33 which is also curved to form a lower side wall shape for the base 5 which is part circular when seen in cross-section. The upper end portions of the side wall portions 35 are relatively short and straight being parallel to each other. One end of the side wall 32 is closed by the connecting head 7. An end wall 37 can close the other end of the side wall 32 opposite the connecting head 7, the end wall 37 having an opening 39 therein aligned with the opening 31 in the head 7.

The bottom wall 33 of the base 5 has support means 41 for supporting the detonator DE. The support means 41 can comprise a slightly raised platform 43, extending longitudinally with a top surface 45 curved to match the cylindrical surface of the casing C of the detonator DE. This surface 45 is aligned with the opening 31 in the block 7 as seen in FIG. 6. The surface 45 preferably is semi-circular. The detonator DE, when properly mounted on the base 5, sits with its casing C on the raised platform 43 in the base 5 and with its leading explosive end LE within the opening 31 in the block 7. The leading end LE is adjacent the slot 11 as shown in FIG. 5. The detonator signal line DSL extends from the resilient bushing B at the tailing end TE of the detonator casing C through the opening 39 in the end wall 37.

Figure 8:
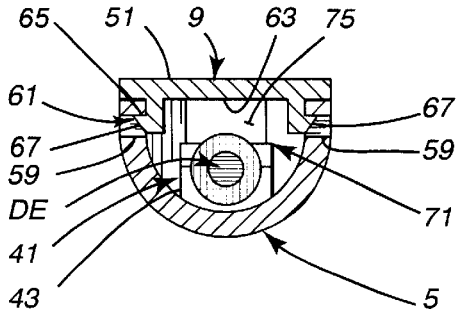
FIG. 8 is a transverse cross-section view showing the cover closed and locked to the body member with the detonator in place in the connector.
Figure 9:
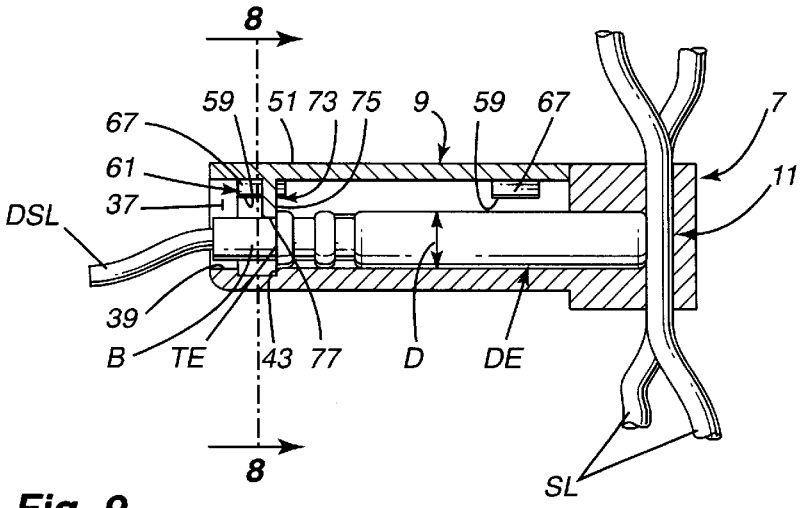
FIG. 9 is a longitudinal cross-section view showing the cover closed and locked to the body member with the detonator in place in the connector.

The connector 1 includes the cover 9 to close the open base 5 and to retain the detonator DE against movement so that its leading explosive end LE stays in contact with the signal lines SL in the slot 11. The cover 9 has a top wall 51 sized to close the open base 3, the cover resting on the top edges 53, 55 of the side wall 32 of the base 5. Cooperating locking means are provided on the base 5 and the cover 9 for locking the cover to the base with the detonator DE in position on the base 5. The locking means on the base 5, as shown in FIGS. 1, 2 and 8, can comprise four openings 59 in the side wall 32, two on each side, and spaced slightly below the top edges 53, 55. The two openings 59 on each side are spaced apart longitudinally. The cooperating locking means on the cover 9 comprise four locking fingers 61 extending down a short distance from the bottom surface 63 of the cover, each finger 61 having a short abutment 65 at the end of the finger extending outwardly. The lower outer corners of the abutments 65 are beveled as shown at 67.

When the cover 9 is pressed onto the top edges 53, 55 of the side wall 32 with the fingers 61 aligned with the openings 59, the beveled corners 67 of the abutments 65 cam the fingers 61 inwardly to allow them to slide down the inner surfaces of the side wall 32 until they reach openings 59 at which point the fingers 61 move outwardly to their rest position. The abutments 65, now lying within the openings 59, as seen in FIG. 8, prevent the withdrawal of the fingers 61 and thus removal of the cover 9.

The cover 9 includes retainer means 71, separate from the locking means, for retaining the detonator DE against longitudinal movement within the connector, and against transverse or pivoting movement up from the support, so as to maintain the leading end LE of the detonator DE in contact with the signal lines SL. The retainer means 71 can comprise at least one stop member 73 located on the cover 9 so that it extends down from the bottom surface 63 of the cover 9 to partly encircle the resilient bushing B extending out from back of the detonator casing C just behind the tailing end TE of the casing. The inner side 75 of the stop member 73 nearly abuts the tailing end TE of the casing C while pressing down on the bushing B with an outer concave surface 77 thus preventing withdrawal of the detonator DE from the connector and ensuring that the leading end LE of the detonator remains in operative position. If desired, a second stop member (not shown), similar to the first stop member 73, could also extend down from the bottom surface of the cover to bear on the detonator casing C just behind the connector head 7. This second stop member would form part of the retaining means.

Figure 7:
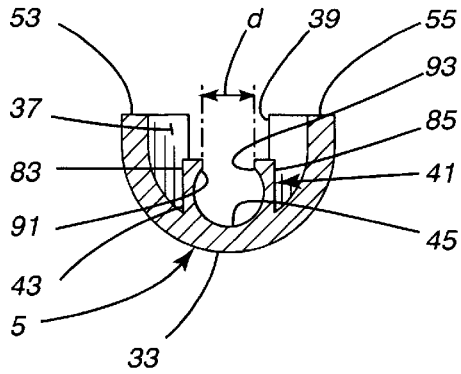
FIG. 7 is a cross-section view along line 7—7 in FIG. 2.

Second retainer means 81 can be provided on the base 3 for helping to retain the detonator DE on the platform 43. The second retainer means can comprise two relatively thin, short wall sections 83, 85 extending up from the top edges of the sides 87, 89 of the platform 43, as shown in FIGS. 2 and 7. The wall sections 83, 85 are generally parallel to each other and each has an inwardly directed abutment strip 91, 93 adjacent its top edge. The distance "d" between the abutment strips 91, 93 is less than the diameter "D" of the casing C. The detonator DE is slid under the abutments 91, 93 as it slides along the surface 45 of the platform 43. The abutments help retain the detonator on the platform.

The cover 9 is shown connected to the base 3 by a flexible strip 95, one end of the strip 95 connected to one side 97 of the cover 9 and the other end of the strip 95 connected to the top of one side wall 33. The strip 95 is long enough and flexible enough to allow the cover 9 to be moved from the side of the body 3 over the top of the base 5 and down to close it. Thus the connector 1 is in one piece. Preferably however, the cover 9 is made separately from the body 3 allowing it to be made from material different from the material of the base. More particularly the cover is made from plastic material which can be printed without requiring flame treatment. A suitable plastic cover material would be, by way of example, H.I.P.S. or ABS. The separate body member 3 is usually made from polypropylene. The polypropylene provides a resilient bridge 25 allowing one head portion to move slightly away from the other head portion. It also allows the fingers 61 to flex when the cover 9 is closed; and it allows the abutments 91, 93 to spread apart to insert or remove the detonator DE from them if desired. However polypropylene must be flame treated to be printed.

In use, with base 5 open, one or more signal lines SL are mounted in the slot 11 in the connector head 7 on the connector block 1. The signal lines are passed through the channel 29, via the groove 27. At least one line SL is located opposite the opening 31 in the connector head. The detonator DE is then slide into the platform 43 on the base 5 through the opening 39 in the end wall 37, the detonator DE passing between the abutments 91, 93 with its explosive leading end LE moving into the opening 31 to abut a signal line SL. The cover 9 is then closed onto the base 5 with the stop member 73 abutting the bushing B and lying adjacent the end TE of the casing C so as to prevent withdrawal of the detonator DE from the body member and to form an assembled blasting device. The detonator DE is securely held in place, even with rough handling of the blasting device, ensuring proper operation of the device. When the blasting device is placed in position for use, a signal is sent to the detonator DE through its detonator signal line DSL, exploding the leading end LE and initiating signals through the signal lines SL to ignite blasting charges or other detonators as is well known.

The connector 1 is easily molded and simple to assemble. When used with a separate cover, dangerous printing operations requiring flame treatment can be avoided. With a normally open base, the body member can be easily inspected after removal from a mold to ensure that flashing does not partly or fully close the opening 31 which could prevent proper operation of the device. While the cover 9 has been shown as completely closing the open base 5, the cover can be sized to only partly close the base. The stop member 73 of the first retainer means 71 has been shown as located on the cover 9 to be positioned adjacent the tailing end TE of the casing C of the detonator DE when the cover is closed. However, the stop member 73 could be located on the cover to be positioned on a crimp CR on the casing C if desired. The side wall of the crimp would abut the stop member to prevent longitudinal movment of the detonator.

I claim:

1. A connector block for holding a detonator having an explosive end, the block connector having: a body member and a cover; the body member having an elongated, open, base and a connector head at one end of the base; the connector head having holding means for holding one or more signal lines; the base having support means for supporting the detonator in an operative position with its explosive end in at least close proximity to the signal lines held in the connector head; locking means for locking the cover to the base, when the detonator is mounted on the support means in the operative position, to close the base; and retainer means on the cover to retain the detonator in the operative position when the cover is locked to the base, the retainer means spaced from the connector head when the cover is locked and abutting the detonator in a manner to prevent longitudinal movement of the detonator away from the signal lines.

2. The connector block as claimed in claim 1 wherein the locking means are of the type preventing removal of the cover from the base when locked.

3. The connector block as claimed in claim 2 wherein the open base has two long sides and the cover has two long sides, the locking means on both sides of the base and cover.

4. The connector block as claimed in claim 3 wherein the locking means comprise at least two resilient fingers on each side of the cover extending therefrom, each ringer having an abutment on one side near its free end; and an opening for each finger on the sides of the base, the opening passing the abutment as the finger is inserted into the opening, but preventing the withdrawal of the abutment.

5. The connector block as claimed in claim 1 wherein the cover is connected to the body with a thin, flexible, strip.

6. The connector block as claimed in claim 1 wherein the cover is separate from the body.

7. The connector block as claimed in claim 6 wherein the cover is made from a material that can be printed without requiring flame treatment.

8. The connector block as claimed in claim 7 including an opening in the head adjacent the open base, the opening intersecting the holding means and easily visible for inspection through the open base; the opening sized to receive the explosive end of the detonator.

9. The connector block as claimed in claim 8 wherein the detonator has an outer tubular casing with a trailing end closed by a bushing, the one retainer means sized and located to rest on the bushing adjacent to the trailing end when the cover is locked to the base, the trailing end of the casing adjacent the side of the one retainer means to prevent its longitudinal movement.

10. The connector block as claimed in claim 7 including second retainer means on the support means for retaining the detonator on the support means against transverse movement, the second retainer means being resilient.

11. A connector block as claimed in claim 10 wherein the detonator has an outer tubular casing with a trailing end closed by a bushing, the one retainer means sized and located to rest on the bushing adjacent to the trailing end when the cover is locked to the base, the trailing end of the casing adjacent the side of the one retainer means to prevent its longitudinal movement.

12. The connector block as claimed in claim 7 wherein the locking means comprise resilient fingers on the cover with an abutment on the end of each finger; and an opening for each finger on the base for passing an abutment when the cover is in a locked position on the base.

13. The connector block as claimed in claim 7 wherein the detonator has an outer tubular casing with a trailing end closed by a bushing, the one retainer means sized and located to rest on the bushing adjacent to the trailing end when the cover is locked to the base, the trailing end of the casing adjacent the side of the one retainer means to prevent its longitudinal movement.

14. The connector block as claimed in claim 1 including an opening in the connector head adjacent the open base, the opening intersecting the holding means and easily visible for inspection through the open base; the opening sized to receive the explosive end of the detonator.

15. The connector block as claimed in claim 1 including second retainer means on the support means for retaining the detonator on the support means against transverse movement, the second retainer means being resilient.

16. The connector block as claimed in claim 1 wherein the locking means comprise resilient fingers on the cover with abutments on the end of each finger; and an opening for each finger on the base for receiving an abutment when the cover is in a locked position on the base.

17. The connector block as claimed in claim 1 wherein the detonator has an outer tubular casing with a trailing end closed by a bushing, the one retainer means sized and located to rest on the bushing adjacent to the trailing end when the cover is locked to the base and the detonator is in the operative position, the trailing end of the casing adjacent the side of the one retainer means to prevent its longitudinal movement.

* * * * *